US007578894B2

(12) United States Patent
Reinhold et al.

(10) Patent No.: US 7,578,894 B2
(45) Date of Patent: Aug. 25, 2009

(54) CONTINUOUS PROCESS FOR PRODUCTION OF STEEL PART WITH REGIONS OF DIFFERENT DUCTILITY

(75) Inventors: Patrick Reinhold, Unna (DE); Jürgen Krogmeier, Hövelhof (DE); Johannes Böke, Blomberg (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 196 days.

(21) Appl. No.: 11/894,980

(22) Filed: Aug. 22, 2007

(65) Prior Publication Data

US 2008/0041505 A1 Feb. 21, 2008

Related U.S. Application Data

(62) Division of application No. 10/726,817, filed on Dec. 2, 2003.

(30) Foreign Application Priority Data

Dec. 3, 2002 (DE) ..... 102 56 621

(51) Int. Cl.
*C21D 1/68* (2006.01)

(52) U.S. Cl. ..... 148/639

(58) Field of Classification Search ..... 148/639
See application file for complete search history.

*Primary Examiner*—Roy King
*Assistant Examiner*—Jessee R. Roe
(74) *Attorney, Agent, or Firm*—Andrew Wilford

(57) ABSTRACT

The interior of a furnace is partitioned into two longitudinally extending and transversely adjacent zones, and one of the zones is heated to a substantially higher treatment temperature than the other of the zones, which may or may not be heated. A steel workpiece is conveyed longitudinally through the furnace with a region of the workpiece moving exclusively through the one zone and another region of the workpiece moving exclusively through the other of the zones such that the regions are heated to different temperatures. The treatment temperature in one of the zone is above the $AC_1$ point for the workpiece and the temperature in the other of the zones is close to or below the $AC_1$ point for the workpiece.

8 Claims, 2 Drawing Sheets

CONTINUOUS PROCESS FOR PRODUCTION OF STEEL PART WITH REGIONS OF DIFFERENT DUCTILITY

CROSS REFERENCE TO RELATED-APPLICATION

This is a division of copending patent application Ser. No. 10/726,817 filed 2 Dec. 2003.

FIELD OF THE INVENTION

The present invention relates to a method for heat-treating a steel workpiece. More particularly this invention concerns the production of a steel part having regions of different grain structure and/or ductility.

BACKGROUND OF THE INVENTION

It is known to make various motor-vehicle parts—e.g. tie rods, B-columns, struts, door beams—of hardened steel with uniform ductility and grain structure throughout the entire workpiece. This is accomplished by a heat treatment of the part, raising it to a predetermined temperature and then quenching it in accordance with the desired characteristics of the finished product. The main factor affecting grain structure and/or ductility is the maximum temperature to which the workpiece is heated, that is whether or not it reaches any of several critical temperatures, the so-called $AC_1$-$AC_4$ points.

For specific parts, however, it is desirable for the grain structure to vary from one region to another. One region might need to have exceptional strength while another might need to be able to deform somewhat. This can be accomplished most simply by making the part as a composite of two pieces that are differently treated to have the desired characteristics.

U.S. Pat. No. 5,972,134 describes a one-piece part having regions of different ductility. It is produced by heating it locally before deforming it into the desired shape and then cooling it. The disadvantage of this method is that it is a complex batch operation that does not lend itself to the mass production needed for motor-vehicle manufacture.

German utility model 200 14 361 published 16 Nov. 2000 describes a door post or so-called B-column that is rendered austenitic in a furnace and then is simultaneously deformed and quenched in a die. Some parts of the workpiece are insulated before it is put in the furnace so that they do not become austenitic and thus do not when hardened develop a martensitic grain structure. Such a process is also unwieldy, involving the application and removal of insulation before and after the heat treatment, two extra steps that considerably elevate the cost of the workpiece.

For mass production of parts it is standard to use a continuous furnace through which the parts move along a path on a conveyor. U.S. Pat. No. 4,622,006 describes such a continuous-heating furnace which is provided with means for taking out and inserting workpieces at several locations along the treatment path. Thus it is possible, with a continuously operating furnace, to differently heat treat different workpieces, some staying in the furnace for the full treatment and others only being heated for substantially less time. While this system is indeed very flexible, it does not allow one to produce a single workpiece having regions that are treated differently.

OBJECTS OF THE INVENTION

It is therefore an object of the present invention to provide an improved system for producing a workpiece with regions of different grain structure and/or ductility.

Another object is the provision of such an improved system for producing a workpiece with regions of different grain structure and/or ductility which overcomes the above-given disadvantages, that is which allows such workpieces to be produced in a simple and continuous process that lends itself to a low-cost mass-production operation.

SUMMARY OF THE INVENTION

According to the invention the interior of a furnace is partitioned into two longitudinally extending and transversely adjacent zones, and one of the zones is heated to a substantially higher treatment temperature than the other of the zones, which may or may not be heated. A steel workpiece is conveyed longitudinally through the furnace with a region of the workpiece moving exclusively through the one zone and another region of the workpiece moving exclusively through the other of the zones such that the regions are heated to different temperatures.

This method can be carried out on an unhardened workpiece or on one that has already been hardened. In the former case, part of the workpiece is hardened and part of it is either left untreated, or hardened less. In the latter case a part of the workpiece is heated sufficiently to soften or anneal it, and the remainder is left in its hardened condition. Either way, the result is a workpiece with adjacent regions of different hardness/ductility.

The treatment temperatures in the two furnace zones are selected according to the desired workpiece characteristics. When for example a motor-vehicle B-column is being made its foot should be quite ductile so that, in an accident, it can bend at its lower end without breaking off. The shaped part is thus moved through the furnace with its foot in the lower-temperature zone. The zone with the foot is maintained below the $AC_1$ point (the temperature at which austenite begins to form) and the zone with the rest of the post is maintained above the $AC_3$ point (the temperature at which all the ferrite has been transformed to austenite). After heat-treatment according to the invention, the workpiece is subjected to the normal hardening steps, e.g. simultaneous quenching and clamping in a die. Thus the foot in the other zone is left ductile, as its grain structure will remain substantially unchanged, while the balance of the post is very strong.

According to the invention the treatment temperature in one of the zones can be above the $AC_1$ point for the workpiece and the temperature in the other of the zones below the $AC_1$ point for the workpiece. This is ideal for a workpiece, e.g. a strip, that has been partially hardened before the zone-wise treatment according to the invention.

It is also possible simply to leave the other zone unheated. This is done when the workpiece has its final shape and merely needs to be hardened in one region. The other zone is thus generally at ambient temperature, below anything that would affect the grain structure of steel.

Also according to the invention the other zone is heated to between the $AC_1$, point and the $AC_3$ point of the workpiece and the one zone is heated to above the $AC_3$ point of the workpiece. Thus there is partial conversion in the low-temperature zone but complete grain-structure conversion in the high-temperature zone.

Steel that has a carbon content greater than 0.8% is treated in another system of this invention where the other zone is heated to slightly below the $AC_1$ point of the workpiece and the one zone is heated to slightly above the $AC_3$ point of the workpiece. Thus the low-temperature region is annealed and its grain structure is relaxed.

In order to prevent oxidation of the workpiece, an inert gas is injected into the furnace. The gas can be, for example, nitrogen.

An apparatus for heat-treating a steel workpiece according to the invention thus has a longitudinally extending furnace subdivided internally by partitions into at least two longitudinally extending and transversely adjacent zones. Means such as electrical coils or burners are provided for heating one of the zones to a substantially higher treatment temperature than the other of the zones. A conveyor transports the workpiece longitudinally through the furnace with a region of the workpiece moving exclusively through the one zone and another region of the workpiece moving exclusively through the other of the zones such that the regions are heated to different temperatures.

The furnace normally is of the tunnel type, with a longitudinally throughgoing conveyor made of rollers. The workpieces push each other through the furnace, or the rollers are rotated to advance them. Alternately the furnace can be of the carousel type with an annular path for the workpieces. No matter what the shape of the oven, the partition extends parallel to the path of movement of the workpieces through it.

The partitions in accordance with the invention include a longitudinally extending upper partition above the transport means and a longitudinally extending lower partition below the transport means and vertically aligned with the upper partition. The upper and lower partitions define a transversely open gap through which the transport means and the workpiece extend.

It is possible for one of the partitions to be displaceable transversely through a plurality of different transversely offset positions. This way the furnace can accommodate differently proportioned workpieces. In this arrangement there can be a plurality of the lower partitions is transversely offset from each other and the upper partition is displaceable transversely through positions aligned with each of the lower partitions.

The partitions can also include a middle longitudinally extending partition aligned vertically between the upper and lower partitions. The conveyor means transports the middle partition through the furnace with the workpiece. Thus a complex three-dimensional workpiece can be treated without excessive heat leakage between the furnace zones. This system is particularly applicable to a furnace where the workpiece is carried on a support, typically a plate.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
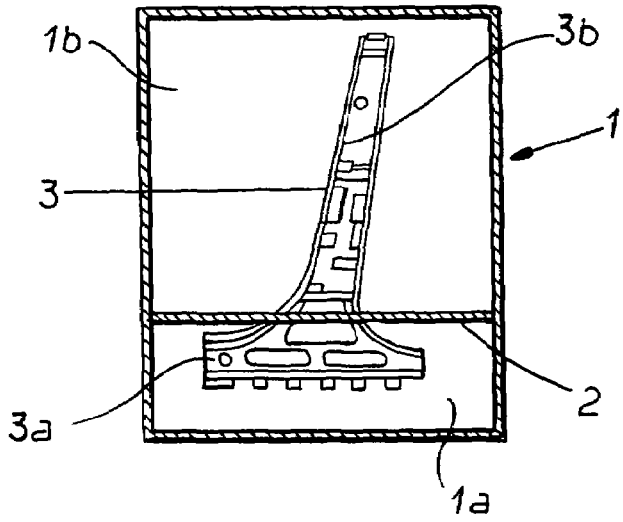
FIG. 1 is a largely schematic end view of a furnace for carrying out the method of this invention.

As seen in FIG. 1 a furnace 1 is internally subdivided by a partition 2 into two zones 1*a* and 1*b*. A B-column 3 is moved through this furnace 1 in a direction perpendicular to the plane of the view and is positioned such that one region 3*a* lies in the zone 1*a* and another region 3*b* lies in the zone 1*b*, the partition 2 of course being slotted to allow the workpiece 3 to be thus positioned. The workpiece 3 is made of hardenable steel with an $AC_1$ point (the temperature at which austenite begins to form) of 740° C. and an $AC_3$ point (the temperature at which all the ferrite has been transformed to austenite) of 850° C. It is heated in the zone 1*a* to a temperature of about 700° C. and in the zone 1*b* to a temperature of about 950° C. The workpiece 3 is subsequently worked and ends up having substantially greater strength in the region 3*b* and greater ductility in the region 3*a*.

Figure 2:
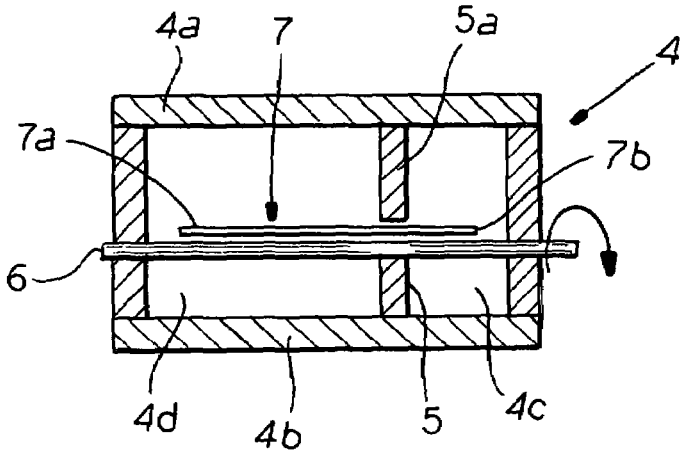
FIGS. 2 through 4 are further views like FIG. 1 of other furnaces in accordance with the invention.

FIG. 2 shows a furnace 4 having a roof 4*a* from which hangs a short vertical partition 5*a* and a floor 4*b* on which stands another short vertical partition 5, with conveyor rollers 6 extending through the gap between the two partitions 5 and 5*a*. A workpiece 7 is supported on the rollers 6 that are rotated as indicated by the arrow to advance it horizontally through the furnace 4, with one region 7*a* in a zone 4*d* to one side of the partitions 4 and 4*a* and another region 7*b* in a zone 4*c* to the opposite side. The zone 4*c* is cooler than the zone 4*d* and heat is mainly applied to the zone 4*d*.

Figure 3:
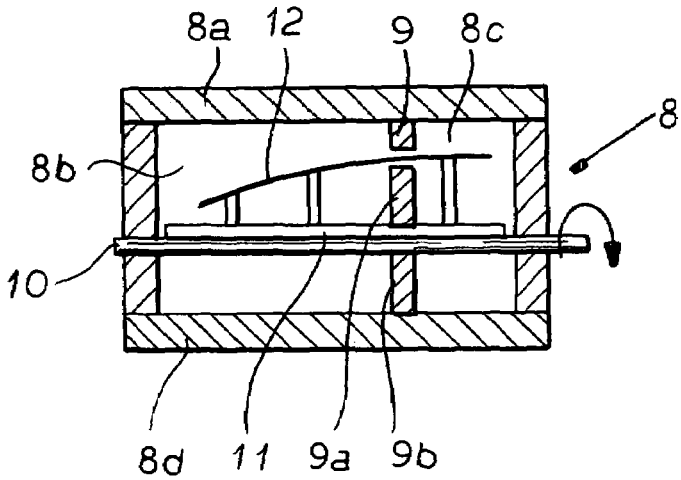

The furnace 8 of FIG. 3 has a top wall 8*a* with a short depending partition 9, a floor 8*d* supporting a short partition 9*b* and rollers 10 that advance a three-dimensional workpiece 12 on a support 11. In order to fill the large gap between the partitions 9 and 9*b*, a short partition 9*a* is carried on the support 11 and moved through the furnace 8 with the workpiece 12. Once again, the temperature is different in the zones 3*b* and 3*c* defined to opposite sides of the partitions 9, 9*a*, and 9*b*.

Figure 4:
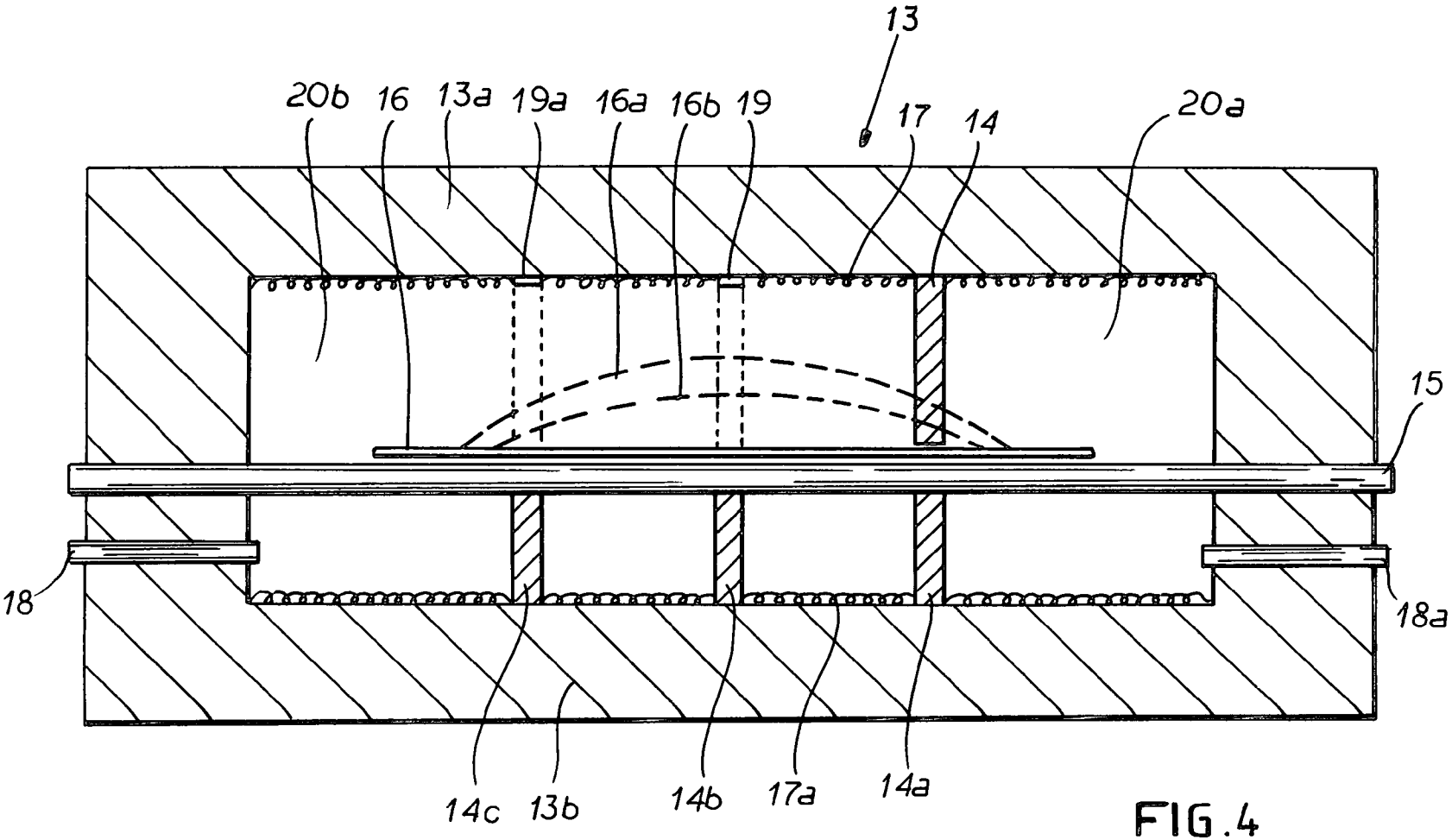

The furnace 13 of FIG. 4 has a single upper partition 14 depending from a roof 13 and extending parallel to the transport direction which once again is perpendicular to the plane of view. Three further partitions 14*a*, 14*b*, and 14*c* extending parallel to each other and spaced transversely stand on a floor 13*b* of the furnace 13, with the partition 14*a* coplanar with the partition 14. Conveyor rollers 15 advance workpieces 16 through the furnace 13. Dashed lines 16*a* and 16*b* show how, instead of planar workpieces 16, three dimensional workpieces can be accommodated.

Thus the furnace is subdivided longitudinally into a compartment 20*a* to one side of the two partitions 14 and 14*a* and a compartment 20*b* to the other side thereof, with the workpiece 16 extending between the chambers. Heaters 17 on the roof 13*a* and 17*a* on the floor 13*b* heat the chambers 20*a* and 20*b* to different temperatures. The upper partition 14*a* can be moved into alignment with either of the partitions 14*b*. or 14*c*, to which ends gaps 19 and 19*a* are formed in the roof heater 17, so as to accommodate differently shaped workpieces.

After the workpiece is taken out of any of the above-described furnaces it is typically subjected to a hot-working process or otherwise hardened. The result is that the region is treated at lower temperature will have radically different ductility and/or hardness than the region of the workpiece treated at-the higher temperature in the furnace. In a situation where one region of the workpiece is not subjected to any further hardening operation, its zone of the furnace is in fact left unheated.

We claim:

1. A method of heat-treating a workpiece of hardenable steel, the method comprising the steps of:

partitioning the interior of a furnace into two longitudinally extending and transversely adjacent zones;

heating one of the zones to a substantially higher treatment temperature than the other of the zones; and conveying the workpiece longitudinally through the furnace with a region of the workpiece moving exclusively through the one zone and another region of the workpiece moving exclusively through the other of the zones such that the regions leave the furnace at different temperatures.

2. The heat-treatment method defined in claim 1 wherein the treatment temperature in one of the zones is above the $AC_1$ point for the workpiece and the temperature in the other of the zones is below the $AC_1$ point for the workpiece.

3. The heat-treatment method defined in claim 1 wherein the other zone is not heated.

4. The heat-treatment method defined in claim 1 wherein the other zone is heated to between the $AC_1$ and $AC_3$ points of the workpiece and the one zone is heated to above the $AC_3$ point of the workpiece.

5. The heat-treatment method defined in claim 1 wherein the other zone is heated to slightly below the $AC_1$ point of the workpiece and the one zone is heated to slightly above the $AC_3$ point of the workpiece.

6. The heat-treatment method defined in claim 1 wherein the workpiece is unhardened prior to conveyance through the furnace, the other zone being heated sufficiently to harden the other region of the workpiece.

7. The heat-treatment method defined in claim 1 wherein the workpiece is hardened prior to conveyance through the furnace, the other zone being heated sufficiently to anneal and soften the other region of the workpiece.

8. The heat-treatment method defined in claim 1, further comprising the step of injecting an inert gas into the furnace and thereby preventing oxidation of the workpiece.

* * * * *